US011383916B2

(12) United States Patent
Trinko et al.

(10) Patent No.: US 11,383,916 B2
(45) Date of Patent: Jul. 12, 2022

(54) CENTER-PULL BAG DISPENSER WITHOUT SEPARATE END-FORMS

(71) Applicant: The Trinko Group, LLC, Appleton, WI (US)

(72) Inventors: Thomas Trinko, Menasha, WI (US); Dominic Trinko, LaCrosse, WI (US)

(73) Assignee: The Trinko Group, LLC, Appleton, WI (US)

( * ) Notice: Subject to any disclaimer, the term of this patent is extended or adjusted under 35 U.S.C. 154(b) by 257 days.

(21) Appl. No.: 16/870,122

(22) Filed: May 8, 2020

(65) Prior Publication Data

US 2020/0354138 A1 Nov. 12, 2020

Related U.S. Application Data

(60) Provisional application No. 62/845,536, filed on May 9, 2019.

(51) Int. Cl.

| | |
|---|---|
| ***B65D 75/00*** | (2006.01) |
| ***B65D 83/08*** | (2006.01) |
| ***B65D 33/00*** | (2006.01) |

(52) U.S. Cl.

CPC ..... *B65D 83/0805* (2013.01); *B65D 33/002* (2013.01); *B65D 75/002* (2013.01)

(58) Field of Classification Search

CPC . B65D 83/0805; B65D 33/002; B65D 75/002

USPC ..... 206/410, 497

See application file for complete search history.

(56) References Cited

U.S. PATENT DOCUMENTS

| | | | | |
|---|---|---|---|---|
| 4,467,916 | A * | 8/1984 | Hedden | B65H 55/00 206/409 |
| 5,549,959 | A * | 8/1996 | Compton | B65D 75/002 206/397 |
| 7,036,663 | B2 * | 5/2006 | Itkonen | B65B 25/148 206/413 |
| 7,428,966 | B2 * | 9/2008 | Goodall | B65D 85/672 206/226 |
| 11,220,394 | B2 * | 1/2022 | Anklam | B65D 85/62 |
| 2004/0217122 | A1 | 11/2004 | Trinko et al. | |
| 2006/0078232 | A1 | 4/2006 | Trinko | |
| 2011/0315582 | A1 * | 12/2011 | Chow | B65B 53/063 206/410 |
| 2015/0090626 | A1 * | 4/2015 | Pirtle | B65B 61/14 53/399 |
| 2016/0001961 | A1 | 1/2016 | Trinko et al. | |
| 2018/0079877 | A1 * | 3/2018 | Ishimaru | B29D 7/01 |
| 2019/0135514 | A1 * | 5/2019 | Huerta | B32B 27/304 |
| 2020/0002071 | A1 * | 1/2020 | Anklam | B65D 71/08 |

* cited by examiner

*Primary Examiner* — Jacob K Ackun

(74) *Attorney, Agent, or Firm* — Boyle Fredrickson, S.C.

(57) ABSTRACT

An improved package for core-less rolls of bags provides a shrink-wrap film around the bag having differential shrinkage to better accommodate the roll form.

8 Claims, 10 Drawing Sheets

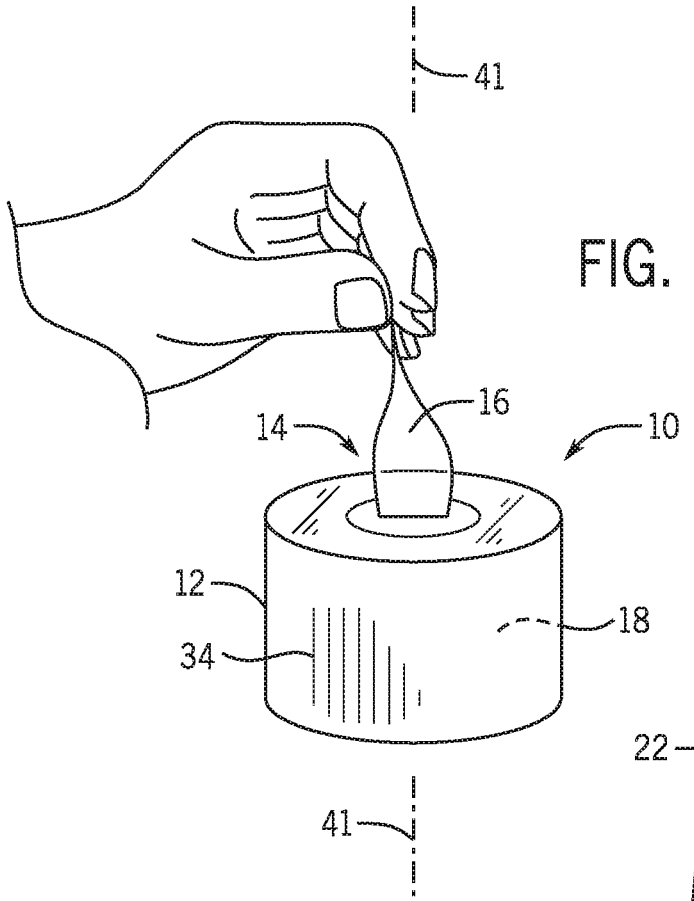
FIG. 1
FIG. 2a
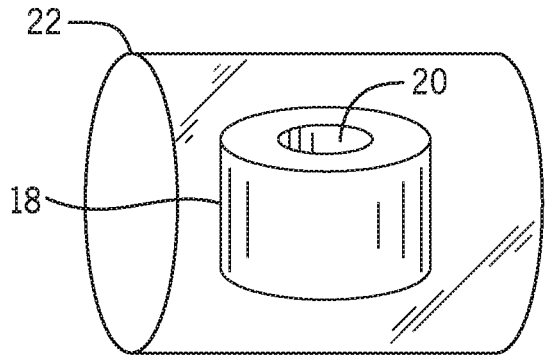
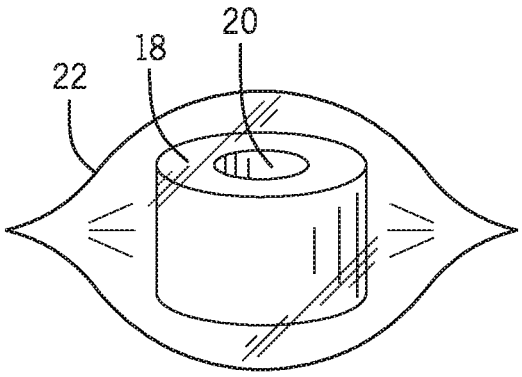
FIG. 2b
FIG. 2c
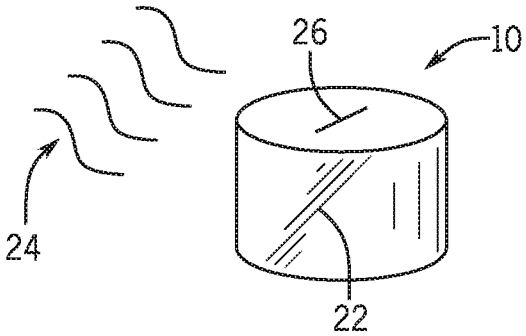

CENTER-PULL BAG DISPENSER WITHOUT SEPARATE END-FORMS

CROSS REFERENCE TO RELATED APPLICATION

This application claims the benefit of U.S. provisional application 62/845,536 filed May 9, 2019 and hereby incorporated in its entirety by reference.

STATEMENT REGARDING FEDERALLY SPONSORED RESEARCH OR DEVELOPMENT

BACKGROUND OF THE INVENTION

The present invention relates to a plastic bag dispensing system and in particular to a plastic bag dispenser that minimizes dispenser size and waste.

Plastic bags can be bulky and hence are normally rolled or folded into a compact form that may be held, for example, in a cardboard container for shipping and dispensing.

For certain applications, for example, disposal of dog waste or infant diapers, it would be useful to have multiple plastic bags in a compact package for dispensing. In these applications, the provision of an outer cardboard or similar container can substantially increase the size and weight of the package, rendering it too bulky or heavy for convenient carrying, for example, in a purse or the like.

US patent publication 2016/0001961, assigned to the assignee of the present invention and hereby incorporated by reference describes a low-bulk, low weight container for dispensing compacted plastic bags. The dispenser forms the bags into a core-less roll, places circular end forms on the roll and then uses the outer periphery of the core to support a heat-shrink film providing a protective outer package. The core-less roll may provide bags that are held to each other only by electrostatic or similar attraction and the package and the roll may cooperate to queue a later bag after a previous bag is removed.

SUMMARY OF THE INVENTION

The present invention provides an improvement on the above referenced application in which the end forms are eliminated in favor of a differentially shrinking shrink-wrap tube which shrinks inward over the ends of the roll to provide a substitute for the separate and forms without overly compressing the center of the roll. The differential shrinking can be implemented either through a tenter frame that provides different amounts of stretch to a shrink material or through the use of a heat sealing process which creates a varying diameter shrink-wrap tube.

Specifically, in one embodiment, compact plastic bag-dispensing package provides a core-less roll providing a web of plastic bags having a sleeve of shrink-wrap material positioned around the core-less roll and providing a central aperture through which plastic bags may be extracted through the sleeve from the web of plastic bags. The sleeve is adapted to provide, upon the application of heat, different predetermined amounts of shrinkage at different portions of the sleeve associated with different areas of contact of the core-less roll.

It is thus a feature of at least one embodiment of the invention to permit a shrink-wrap material to provide a packaging for core-less rolls of bags with improved stabilization of those bags by more even conformance to the roll shape. It is another feature of the invention to allow the shrink-wrap to conform to the roll shape without placing undue pressure on larger sections of the roll that would tend to form the roll. Increased resistance force to shrinkage is the normal mechanism for close conformance to an irregular shaped by shrink-wrap film but can produce unnecessary distortions in the roll especially without the use of end forms The sleeve may be formed by a heat sealing of sheets of shrink-wrap material to provide a tube open along an axis before shrinking to receive the core-less roll and the different amounts of shrinkage may be controlled by changing the diameter of the sleeve formed by the heat sealing at different locations along the axis It is thus a feature of at least one embodiment of the invention to pre-shape the sleeve to the roles to provide the desired conformance without undue pressure on the roll.

Alternatively, or in addition, the different amounts of shrinkage may be controlled by changing a stretching of the shrink-wrap material prior to heat sealing at different locations along the axis.

It is thus a feature of at least one embodiment of the invention to eliminate the need for complex shaping cutters and sealers by modifying the amount of shrink of the shrink-wrap material.

The sleeve may include an orifice formed in the sleeve to align with a central bore of the core-less roll and the orifice may be provided by a melting of material of the shrink-wrap material to form a thickened rim about the orifice.

It is thus a feature of at least one embodiment of the invention to eliminate the need for additional components to create a robust opening through which the bags are dispensed size to properly retain the bags in connection during the dispensing process The shrink-wrap material may comprise a first and second layer, the first layer presenting an improved affinity for printing ink compared to the second layer.

It is thus a feature of at least one embodiment of the invention to eliminate the need for separate manufacturer steps for application of labels or the like while providing a robust container of shrink-wrap.

These particular objects and advantages may apply to only some embodiments falling within the claims and thus do not define the scope of the invention.

BRIEF DESCRIPTION OF THE DRAWINGS

FIG. 1 is a perspective view of the package of the present invention showing dispensing of a bag from a dispenser package of the present invention having a core-less roll surrounded by a shrink-wrap film;

FIGS. 2*a*-2*c* are simplified perspective views of the steps of producing the package of the present invention showing the formation of a sealed shrink-wrapped bag around a core-less roll, shrinking the bag to conformity with the core-less roll, and adding a slot-dispensing feature;

DETAILED DESCRIPTION OF THE PREFERRED EMBODIMENT

General Description

Figure 3:
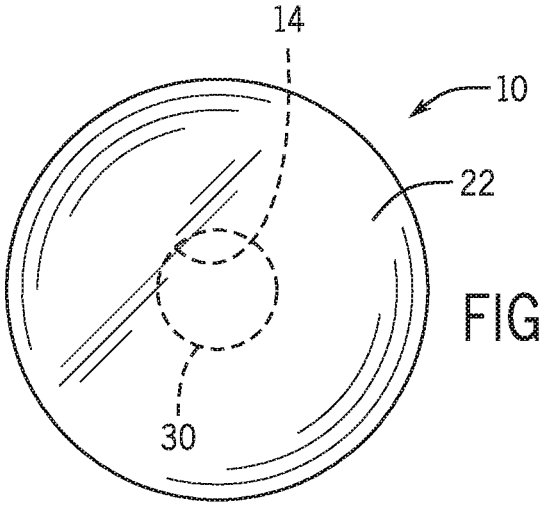
FIG. 3 is a top plan view of the core-less roll of FIG. 1 showing a first dispensing option having a perforated opening.

Referring now to FIGS. 1 and 2*a*, a bag-dispensing package 10 of the present invention may provide a generally cylindrical package form 12 having a dispensing opening 14 in the center of one base of the cylinder. Plastic bags 16 may be dispensed through the opening 14 from a core-less roll 18 generally along a central axis 41.

The core-less roll 18 formed of plastic bags 16 spiral-wound about the central axis 41 and a center, open cylindrical volume 20 without the imposition of a center cardboard tube or the like. In the core-less roll 18, the bags 16 may be attached only by electrostatic force to be readily separated when drawn through the opening 14 from out of the center of the core-less roll 18.

A method of fabricating core-less rolls 18 of plastic bags 16 suitable for use with the present invention may be found in U.S. Pat. Nos. 7,066,422 and 7,273,193 both hereby incorporated by reference in their entirety.

Referring now to FIGS. 2*a*-2*c*, after fabrication of the core-less roll 18, it may be placed within a tube of shrink-wrap (heat-shrink) film 22 of the type known in the art sized to closely conform to the size of the core-less roll 18. When the core-less roll 18 is cylindrical, the shrink-wrap film 22 will conform to its outer periphery being the sidewalk of the cylinder and two opposite cylindrical bases.

As is generally understood in the art, shrink-wrap film 22 will be a polymer film such as a polyethylene or polypropylene stretched when it was warm, for example, on a tenter-frame to reorient, the molecules from their initial patterns in an expanded form so that when heated the shrink-wrap film 22 contracts, typically by an amount greater than 10 percent and often greater than 30 percent In one embodiment, the axis of the tube of shrink-wrap film 22 may be generally perpendicular to the axis of the open cylindrical volume at the center of the core-less roll 18.

As shown in FIG. 2*b*, open ends of the tube of shrink-wrap film 22 may be heat sealed, for example, using an L-bar sealer to provide a closed volume within the shrink-wrap film 22 holding the core-less roll 18.

Referring now to FIG. 2*c*, the application of heat 24 to the shrink-wrap film 22, for example, using a shrink tunnel or hot-air blowers, may then cause the shrinking of the shrink-wrap film 22 to closely conform to the outlines of the core-less roll 18 and in particular to provide a substantially continuous unbroken surface of shrink-wrap film 22 at upper and lower bases of the bag-dispensing package 10.

It will also be appreciated that the shrink-wrap film 22 shown in FIG. 2*a* may be oriented so that the open ends of the tube of the shrink-wrap film 22 are vertically aligned with respect to the core-less roll 18 as depicted. The size of the tube of shrink-wrap film 22 may be adjusted so that in shrinking it provides a natural orifice aligned with the open cylindrical volume 20.

Figure 4:
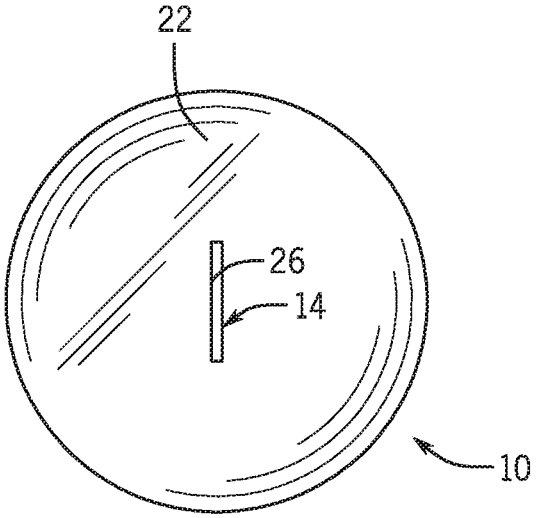
FIG. 4 is a figure similar to that FIG. 3 showing a second dispensing option providing a slit.
Figure 5:
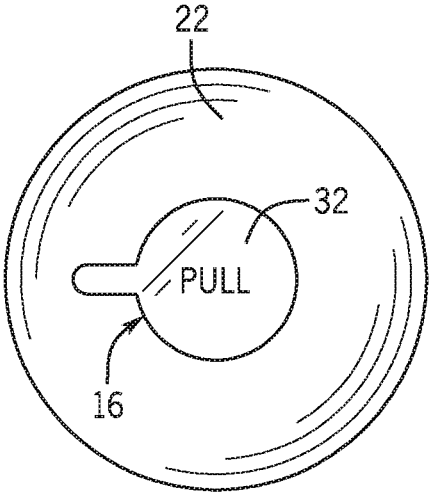
FIG. 5 is a figure similar to that of FIG. 4 showing a third dispensing option providing an adhesive label cover.

Referring now also to FIG. 4, a knife or die may be used to make a slit cut 26 in one base through the heat shrink-wrap film 22 positioned above the center of the open cylindrical volume 20 of the core-less roll 18. The slit cut 26 provides access to bags from the center of the core-less roll 18 through the cut 26 and also serves to retain a next overlapping bag partially, through the cut 26, when the preceding bag is removed, for easy access of the succeeding bag. The slit cut 26 provides the opening 14.

Referring now to FIG. 3, alternatively the shrink wrap film 22 around the opening 14 may be perforated with perforations 30 after the shrinking operation that allow removal of a circular portion of the shrink-wrap film 22 for access to the bags 16 of the core-less roll 18 from the center of the core-less roll 18 through the open volume 20. Because the bags 16 are removed from a center of the core-less roll 18, the outer portions of the core-less roll 18 continue to support the shrink-wrap film 22.

Referring to FIG. 3, an adhesive sticker 32 may be placed over the opening 14 provided in the embodiment of FIG. 3 or FIG. 4 during shipping and then removed for use of the bag-dispensing package 10 by a consumer. A portion of one bag 16 may be partially captured by the sticker 32 during manufacturing so that it is readily accessible upon removal of the sticker 32. Each bag 16 when fully withdrawn from the core-less roll 18 may draw the next bag upward through the opening until the bags 16 are fully consumed.

Referring again to FIG. 1, the outer surface of the bag-dispensing package 10 may be printed with images or text 34 with ink applied directly to the polymer of the shrink-wrap film 22 providing consumer information, product labeling, and the like. In some embodiments two layers of shrink-wrap may be used to provide different characteristics, for example, with a first outer layer having improved adhesion to ink compared to a second inner layer, the latter having superior mechanical strength or puncture resistance. The shrink-wrap film 22 may be transparent or opaque as desired.

End Form Embodiment

Figure 6:
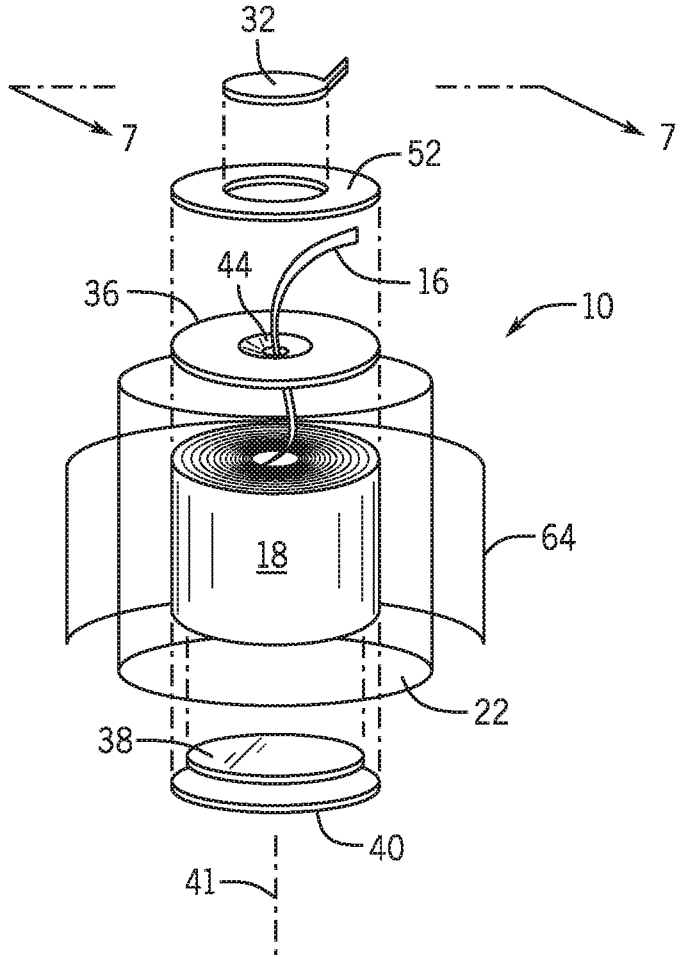
FIG. 6 is an exploded diagram of a second packaging embodiment using rigid end forms within the shrink-wrap bag.
Figure 7:
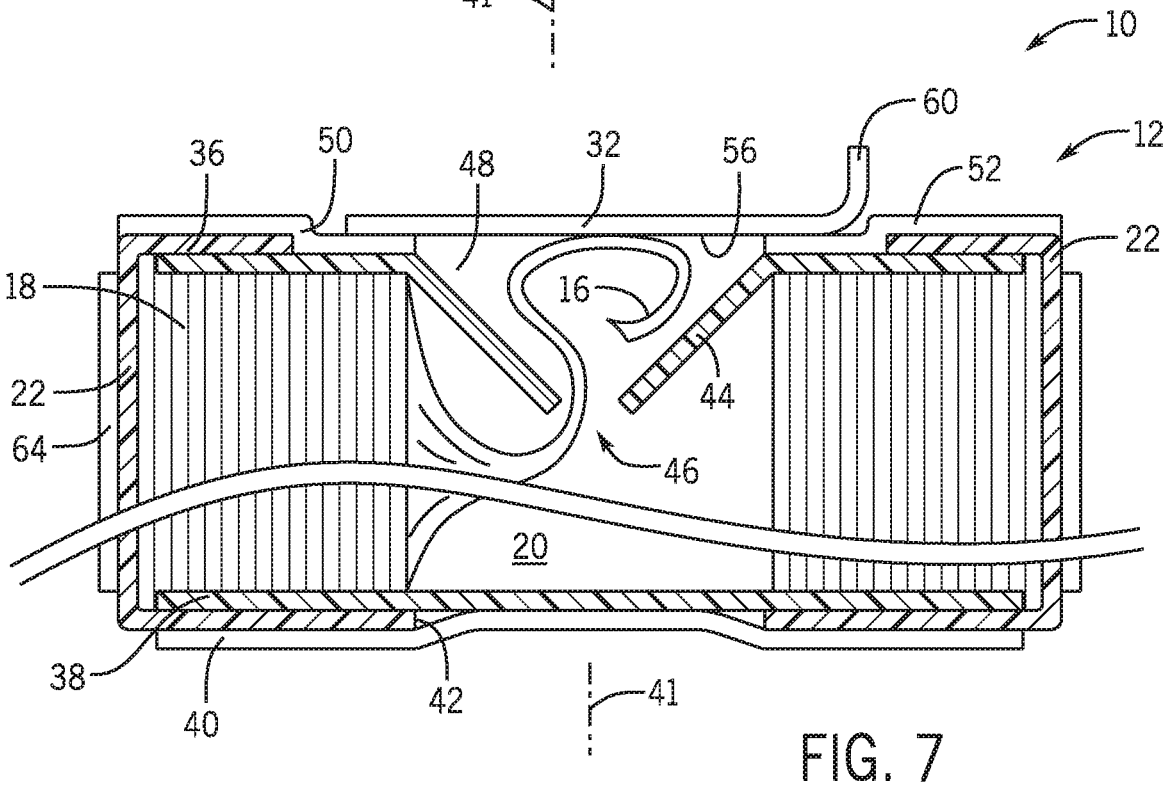
FIG. 7 is a cross-section along line 7-7 of FIG. 6.

Referring now to FIGS. 6 and 7, in an alternative embodiment, end-forms 36 and 38, in the form of circular disks constructed of a relatively stiff material such as cardboard or thermoplastic, may be placed against the upper and lower bases of the core-less roll 18, the latter which approximates a circular cylinder. These end-forms 36 and 38 are then captured against the upper and lower bases of the core-less roll 18 by shrinkage of the shrink-wrap film 22 and, as so held, prevent undue compression of the upper and lower edges of the core-less roll 18 by the shrink-wrap film 22 and protect the core-less roll 18 from deformation during shipping.

A printed circular label 40 of paper or other similar material may optionally cover the lower end-form 38 as adhered thereto, for example, by a pressure sensitive adhesive attached to the printed circular label 40. As so positioned, the printed circular label 40 covers the seam between the inner edge 42 of the shrunken shrink-wrap film to provide a more finished appearance and to seal the package against infiltration of contaminants. The printed circular label 40 also provides a surface on which to print additional information to be displayed on the bottom of the generally cylindrical package form 12, for example, a UPC code and other labeling information.

The upper end-form 36 may provide for an inwardly extending funnel-portion 44 that may serve to capture the end of one bag 16 threaded through an orifice 46 of the funnel-portion 44. As so captured, the end of the bags 16 is held within the funnel-portion 44 extending into the volume 20 and thus recessed within the cylindrical package form 12. The upper end-form 36 may be advantageously injection molded or thermoformed thermoplastic as is understood in the art.

The diameter of the upper end-form 36 and lower end form 38 may be substantially equal to the diameter of the core-less roll 18 to protect the core-less roll 18 from deformation and possible separation of the bags 16. Desirably, the diameter of the upper end-form 36 and lower end-form 38 may be slightly less than the core-less roll 18 so that the sidewalk of the package 10 pillow outward by ⅛ to ¼ inch for pleasing aesthetic effect and to prevent a hard edge of the end forms 36 and 38 from causing abrasion of the shrink-wrap film 22 or unpleasant contact with the consumer. The end forms 36 and 38 are relatively stiff compared to the shrink-wrap film 22 and the bags 16 to retain their shape after minor deformation.

Again the inner seam edge 50 of the upper end of the shrink-wrap film 22 may be covered with a circular paper label 52 having a center opening 54 exposing the funnel-portion 44 and a pressure sensitive adhesive to attach it over the upper end of the cylindrical package form 12. As described above, a sticker 32 may have a pressure sensitive adhesive 56 on its lower surface to cover the opening 54 and the funnel-portion 44 during shipping. The funnel-portion 44 and sticker 32 thus provide an enclosed space 48 beneath the upper end of the cylindrical package form 12 in which the end of the bags 16 may be retained protected yet available for easy access by the consumer. The adhesive on the sticker 32 may retain and hold the end of the bag 16 adhered against the inner surface of the sticker 32 to prevent it from slipping out of the orifice 46. An unadhered tab 60 on sticker 32 may be provided to allow the sticker 32 to be easily removed by pulling the tab 60 upward to remove the sticker 32 and pull with it the end of bag 16.

A thin and flexible paper label 64 may be wrapped around the outer circumference of the shrink-wrap film 22 when it is shrunken to provide a surface supporting additional printed material for the consumer. The label 64 thus eliminates the need for complex printing of the shrink-wrap film 22 if desired. Alternatively a printed shrink-wrap film may be used eliminating the need for the paper label 64 or printing may be applied directly to the shrink-wrap film 22 with appropriate pre-distortion.

Figure 8:
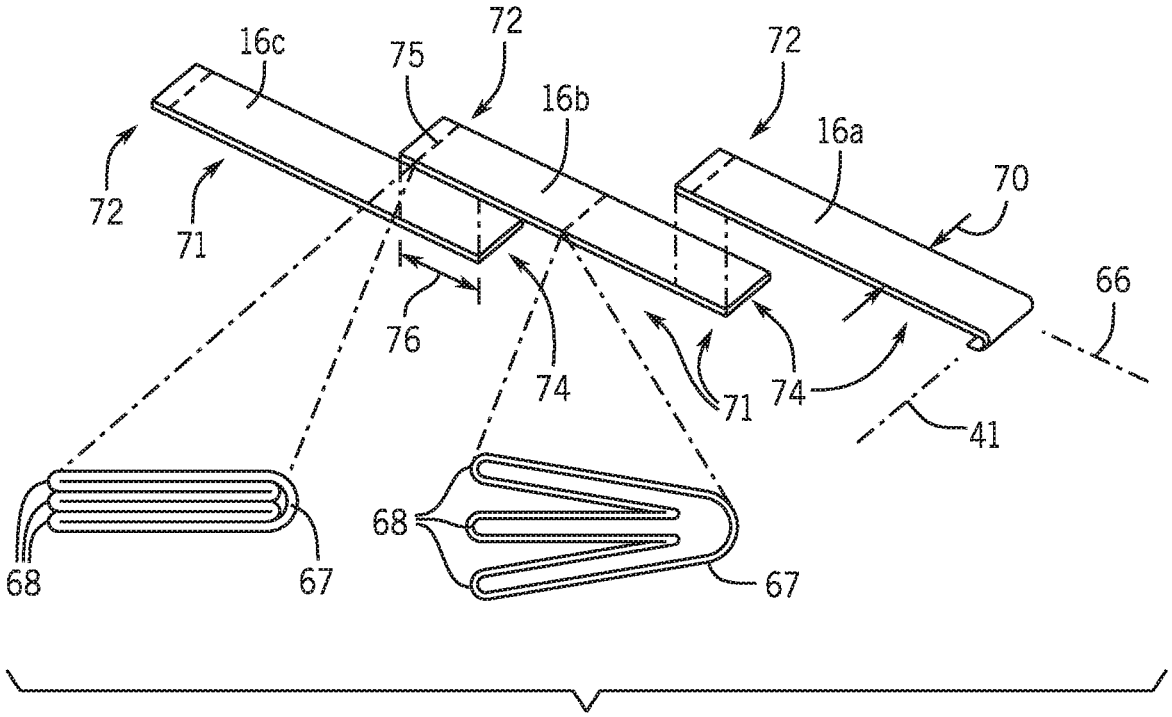
FIG. 8 is an exploded diagram of a web formed of multiple overlapping bags showing pleating in cross-section at various locations on one bag.
Figure 9:
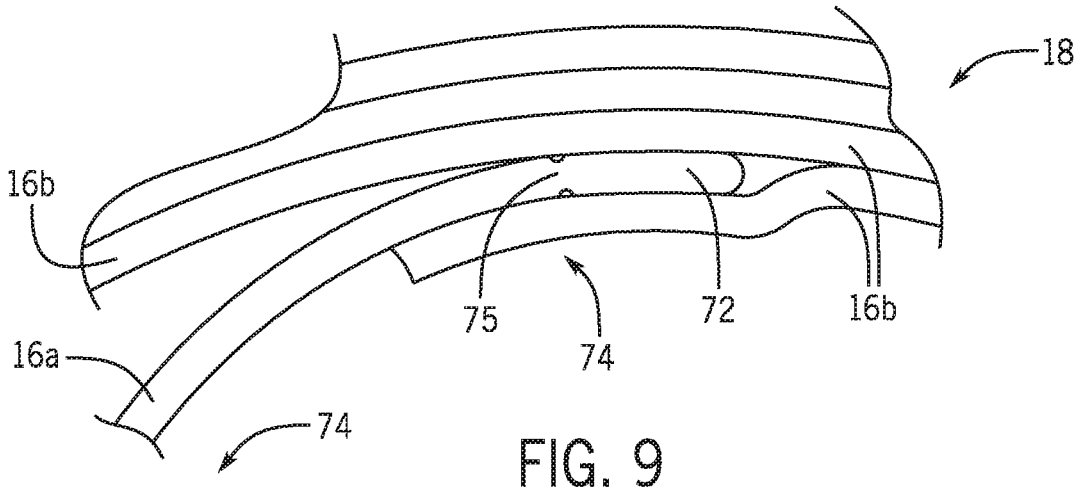
FIG. 9 is a fragmentary top plan view of the core-less roll of FIG. 6 showing the relative overlap of adjacent bags.

Referring now to FIG. 8, each bag 16 may comprise a tubular sleeve 67 of flexible plastic film extending generally along a tube axis 66 and may have multiple pleats 68 extending along the axis to convert the tube into a flattened band 71 having a width 70 (being generally the height of the package 10) much less than the flattened diameter of the tube and, for example, approximately ⅓ of that flattened diameter provided by three pleats extending approximately the full width 70. A closed end 72 of each bag 16 opposite an open end 74 may be heat sealed at a seam line 75 fusing each of the pleats 68 together in overlapping configuration. Each of the bands 71 of different bags 16*a*-16*c* (only three shown for clarity) may be overlapped by an overlap distance 76, for example, being a few inches and much less than one fourth the length of the bag along axis 66. As shown in FIG. 9, each inner bag (e.g. 16*a*) will be withdrawn from the package 10 before an adjacent outer bag (e.g. 16*b*) however the outer bag 16*b* will overlap (underlap) with the inner bag 16*a* on an inner surface of the inner bag 16*a* to help preserve adhesion between the two.

The outside diameter of the cylindrical package form 12 may be sized to fit in a standard automotive cupholder and, for example, may be limited to no more than three inches in diameter and less than four inches in height. The final bags in the core-less roll 18 may be marked with a distinguishing color or the like to signal a need to obtain replacement stock.

It will be appreciated that the present cylindrical package form 12 may be used with existing dispenser racks intended for holding rectangular cardboard boxes through the use of an adapter providing an outer rectangular surface for being held firmly within the dispenser rack and an inner cylindrical bore for holding the present cylindrical package form 12.

It will be appreciated that the design of the package of the present invention not only reduces packaging material but provide substantial flexibility in changing the size of the package simply by changing the number of bags 16 in a core-less roll 18. It will be appreciated that the number of bags may be varied within a given range without necessarily changing any of the other packaging components to the extent that the diameter of the cylindrical package form 12 may change only slightly. It will be appreciated that the bags may be attached by perforations in some embodiments.

End Form Free Embodiment

Figure 10:
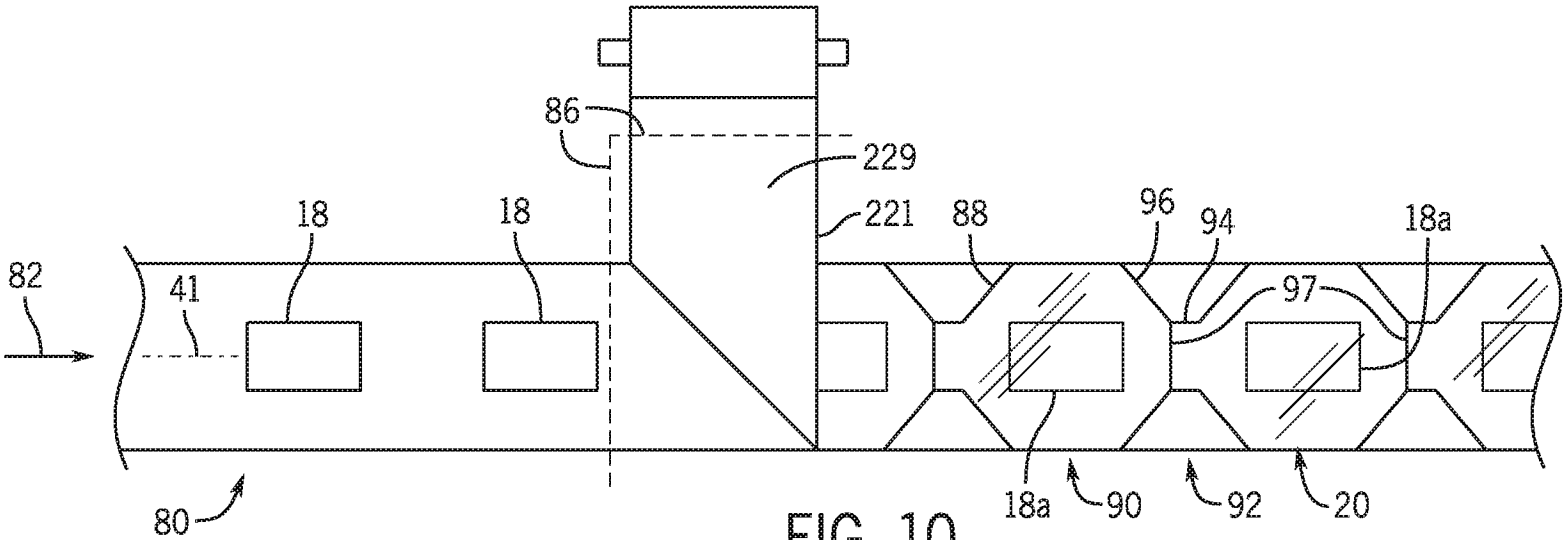
FIG. 10 is a top plan view of a packaging line for packaging the rolls between two sheets of shrink-wrap film heat-sealed and cut to provide differential shrinking.

Referring now to FIG. 10, in an alternative packaging arrangement, the individual core-less rolls 18, prior to packaging, may be placed on an assembly line 80 providing for an axis of motion 82 of the core-less rolls 18 longitudinally. The central axis 41 of each core-less roll 18 is aligned with the axis of motion 82.

Upper and lower shrink-wrap film sheets 22*a* and 22*b* having a dominant shrink axis 86 may be guided above and below each roll 18 to move with the assembly line so that the dominant shrink axis 86 is generally perpendicular to the central axes 41 of each core-less roll 18.

A heat sealing tool (not shown) may press downward on the layers of the upper and lower shrink-wrap films 22*a* and 22*b* sandwiching each roll 18 therebetween. These upper and lower shrink-wrap films 22*a* and 22*b* are then sealed along a seal line 88 providing for generally wide sleeve at a center region 90 holding each core-less roll 18. This center region 90 has substantially constant width for a height of the core-less roll 18 along the axis 41. The center regions 90 are separated by narrow width separating regions 92 between each core-less roll 18. The separating regions 92 may include a neck portion 94 extending from a left end of a core-less roll 18*a* to a right end of a core-less roll 18*b* at which the neck portion 94 is sealed, the neck portion 94 having substantially constant width. A tapered section 96 at about 45° joins the neck portions 94 with the wide sleeve at the center region 90 at each end of the center region 90.

After heat sealing, a cutting knife (not shown) may cut along cut line 97 to cut a right portion of the neck portion 94 (without sealing) away from the sealed end of the neck portion 94 closing the volume of the succeeding roll 18.

Figure 12:
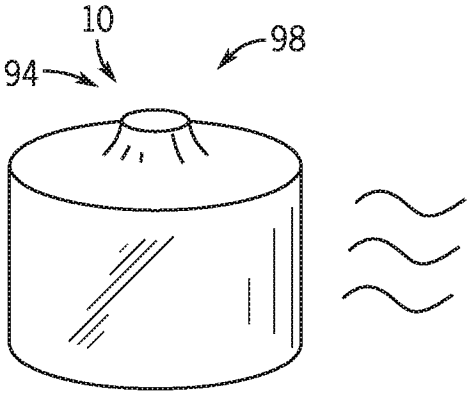
FIG. 12 is a figure similar to that of FIG. 11 after shrinking with a protruding bag exit port formed from the access neck.
Figure 11:
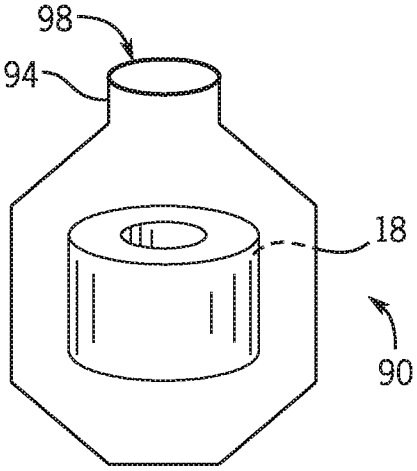
FIG. 11 is a perspective view of a roll within the heat sealed and cut film before shrinking showing a protruding bag access neck.

Referring now to FIG. 11, the core-less roll 18 will thus be in a sealed bag having an opening 98 at the neck portion 94. As shown in FIG. 12, different widths of the neck portion 94 and center region 90 will caused different amounts of shrinking (albeit at a constant shrink rate per unit length) allowing the shrink-wrap film 22 to draw inward to completely cover the ends of the package 10 without the need for end forms 36 or 38 or a label 52, for example, as shown in FIG. 7.

Figure 13:
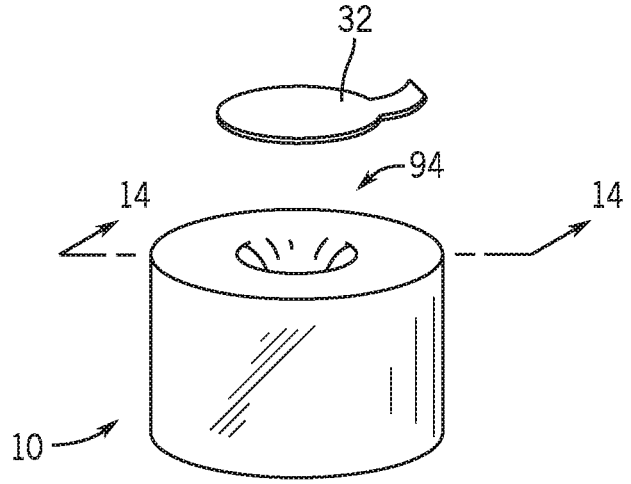
FIG. 13 is a figure similar to FIG. 12 with the bag exit port pressed into the roll and one bag partially extracted for attachment to a sealing sticker.
Figure 14:
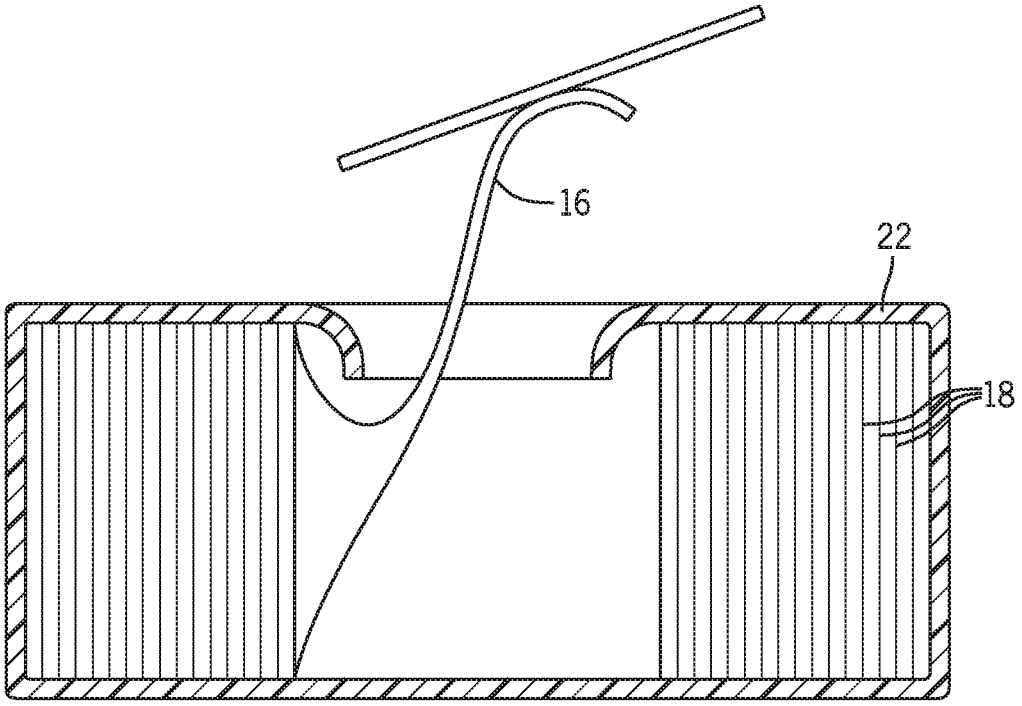
FIG. 14 is a cross-sectional view along line 14-14 of FIG. 13 showing elimination of the separate end forms.

The opening 98 will shrink in diameter and may be pressed inward (as shown in FIG. 13) to fit into the core of the core-less roll in the manner of the funnel-portion 44 of the end form. A sticker 32 or the like as discussed, for example, with respect to FIGS. 6 and 7, may be attached to an exposed end of one of the bags 16 as discussed above with respect to FIGS. 6 and 7.

Figure 15:
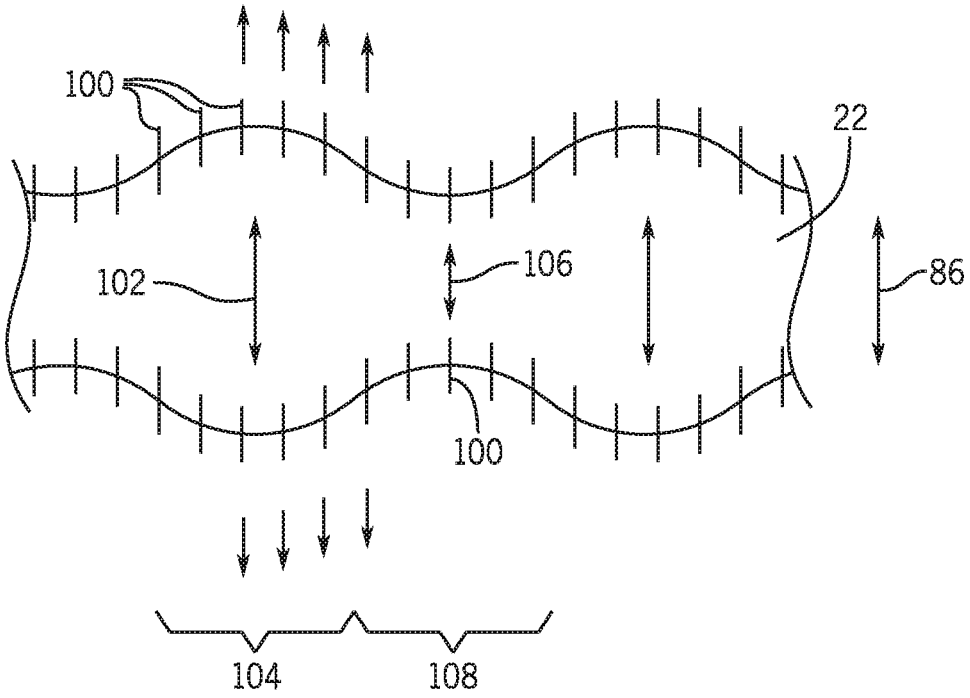
FIG. 15 is a top schematic view of a tenter frame for use in a second embodiment for providing differential stretching of a shrink film prior to use.

Referring now to FIG. 15 in an alternate embodiment (which may be combined with the embodiment of FIGS. 10-14 or used independently) the shrink-wrap film 22 is differentially stretched on a tenter frame having tenterhooks 100 that grip the edge of the shrink-wrap film 22 while it is in the heated stage to provide a first stretching 102 in a region 104 (which will form the neck portion 94) and a second reduced stretching 106 in a region 108 (which will form the center region 90) alternating along a longitudinal length of the shrink-wrap film perpendicular to its dimension 86.

Figure 16:
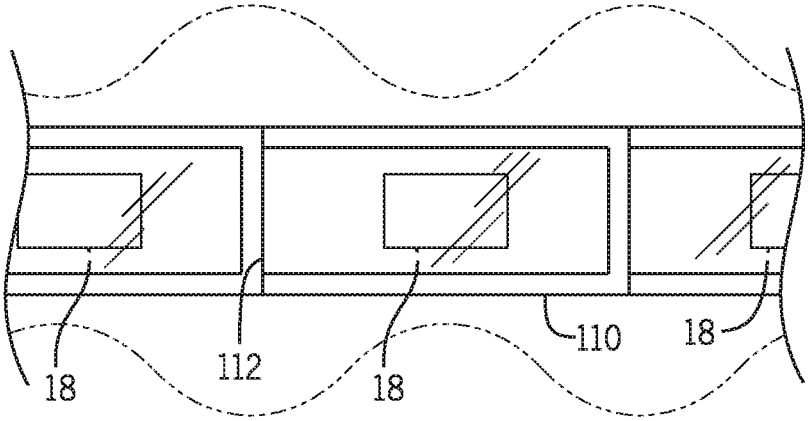
FIG. 16 is a schematic top view of the film (with its original outline shown in dotted lines) after being cut and heat sealed prior to shrinking.

Referring to FIG. 16, this differentially stretched material may be trimmed to a sheet and then sealed along seal lines 110 to create pouches with a rectangular periphery surrounding each roll 18 which may be cut apart along lines 112 to provide pouches having differential shrinking capability that will shrink as shown in FIG. 12 upon the application of heat with the regions at the ends of the rolls 18 shrinking more than the center most region so as to provide coverage of the ends of the rolls without undue compression of the core-less roll such as could cause delamination of the rolls.

While this embodiment allows the elimination of the end forms, it will be appreciated that it also provides advantages and can be used with end forms or lighter weight or simpler end forms. Generally, these techniques allow for control of differential shrinkage In a predetermined manner that does not rely on resistance to shrinkage by the pressure on the roll. Instead differential shrinkage would occur even in the absence countervailing pressure from of a roll contained item.

Reinforced Aperture

Figure 17:
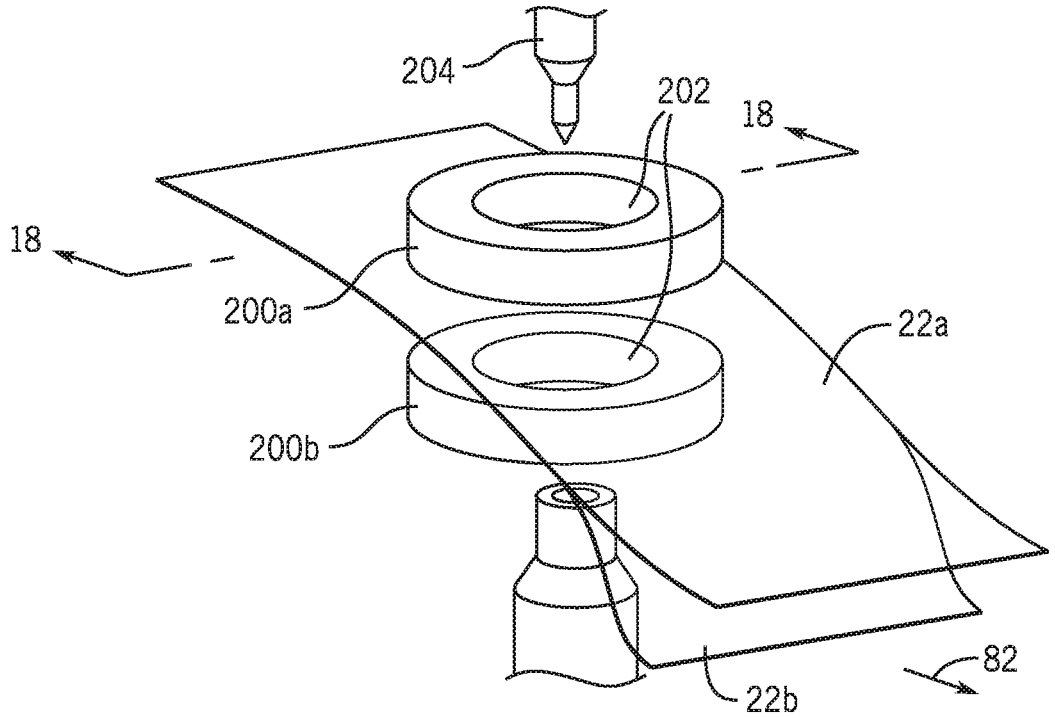
FIG. 17 is a perspective simplified diagram of an aperture forming system for piercing without material removal.
Figure 18:
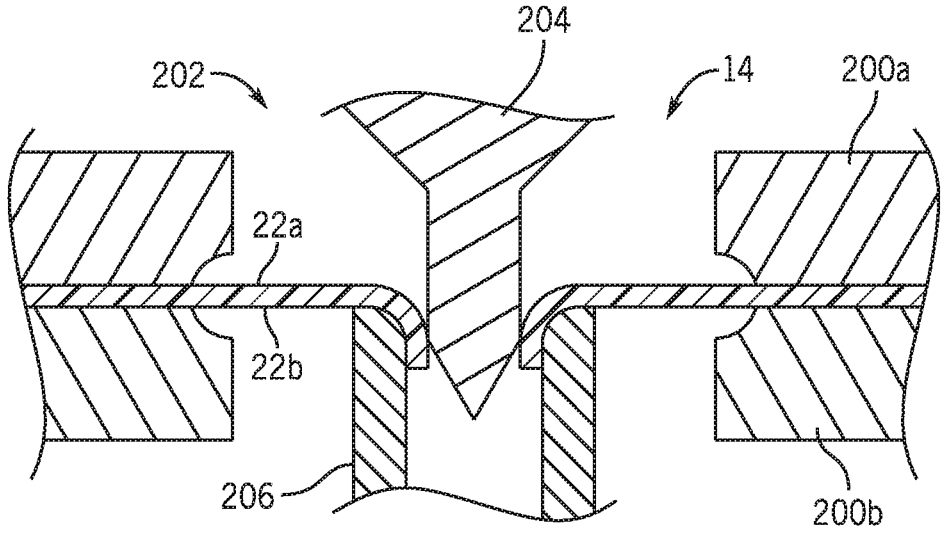
FIGS. 18 and 19 are elevational cross-sections along lines 18-18 of FIG. 7 showing the piercing operation and subsequent heating operation which forms a thickened rim of polymer material for reinforcement of the aperture.
Figure 19:
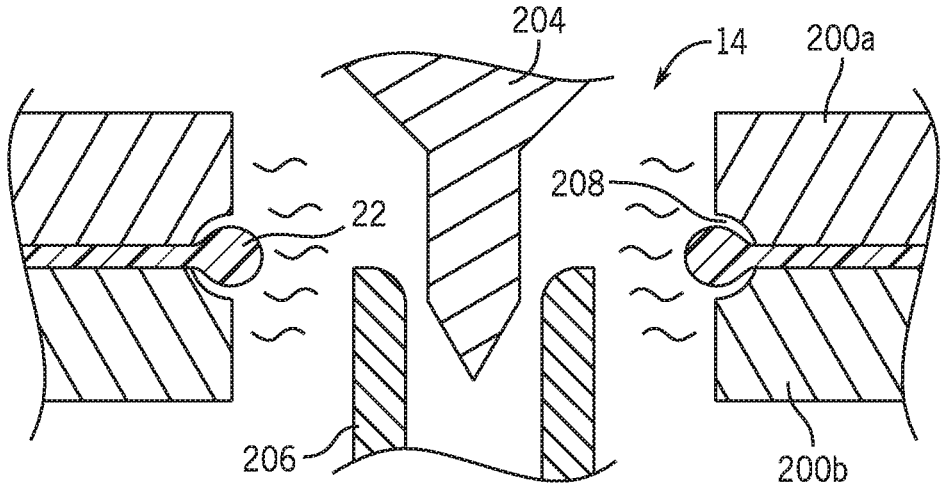

Referring now to FIG. 17, a two-ply shrink-wrap film provides an outer film 22*a* having improved adhesion for printing inks compared to an inner film 22*b* which may be laminated to film 22*a* and which may have superior mechanical properties of strength and puncture resistance compared to film 22*a*. Before or after forming the sheets 22 into a sleeve, the opening 14 (for example as shown in FIG. 1) may be preformed in the sheets 22 by passing the sheets 22, for example, in a continuous process along axis of motion 82, between forming clamps 200*a* and 200*b*. The forming clamps 200 will have aligned central openings 202 approximately the size of the desired opening 14 surrounded by planar surfaces that may abut when the clamps 200 are closed. As shown in FIG. 18, the forming clamps 200*a* and 200*b* may clamp together on opposite sides of the sheets 22 to stabilize the sheets 22. After this, a punch 204 may pass through the central openings 202 in the forming clamps 200 to pierce the sheets 22 against a corresponding receiving die 206. Heat may then be applied to the sheets 22 within the opening 202, for example, by heating of the punch 204 and die 206 or, for example, from a separate heat source to melt the material of the film 22 in the opening 202. This heating causes the sheets 22 within the opening 202 to thicken and shrink back toward the walls of the opening 202, for example, into recesses 208 in those walls limiting the expansion of the opening 14 and defining a thickened rim. In this way, the opening 14 may be sized properly to provide resistance to the exiting bags 16, for example, as shown in FIG. 1 without risk of tearing or the need for additional elements.

Figure 20:
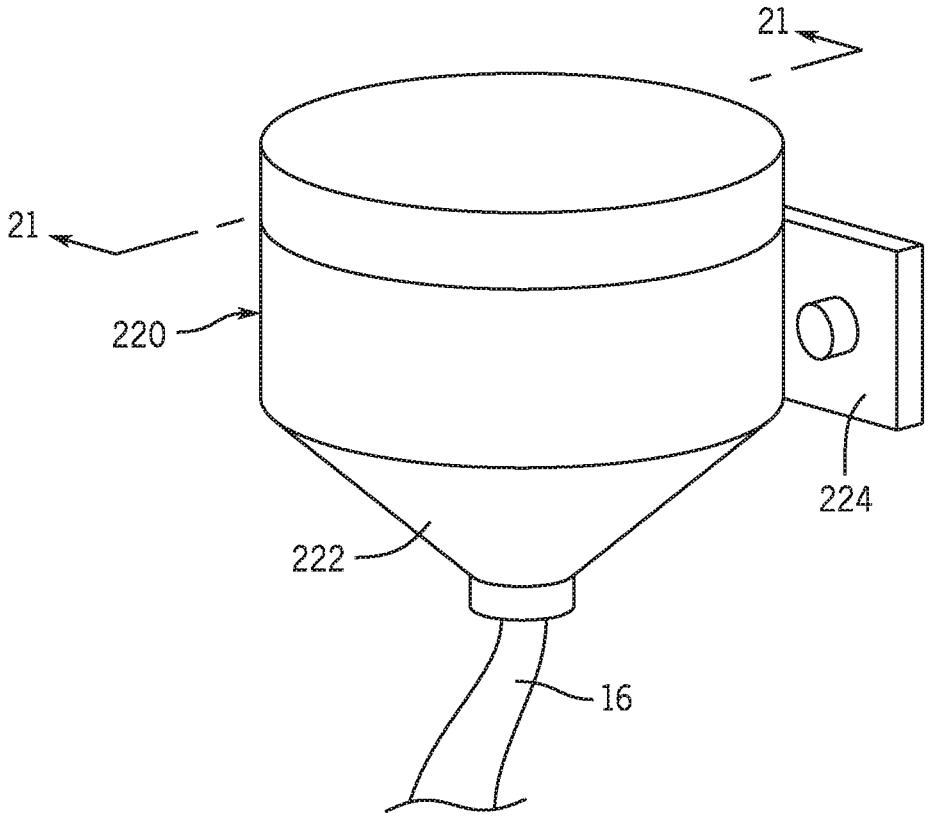
FIG. 20 is a perspective view of a wall mount system for dispensing the core-less rolls of the present invention.
Figure 21:
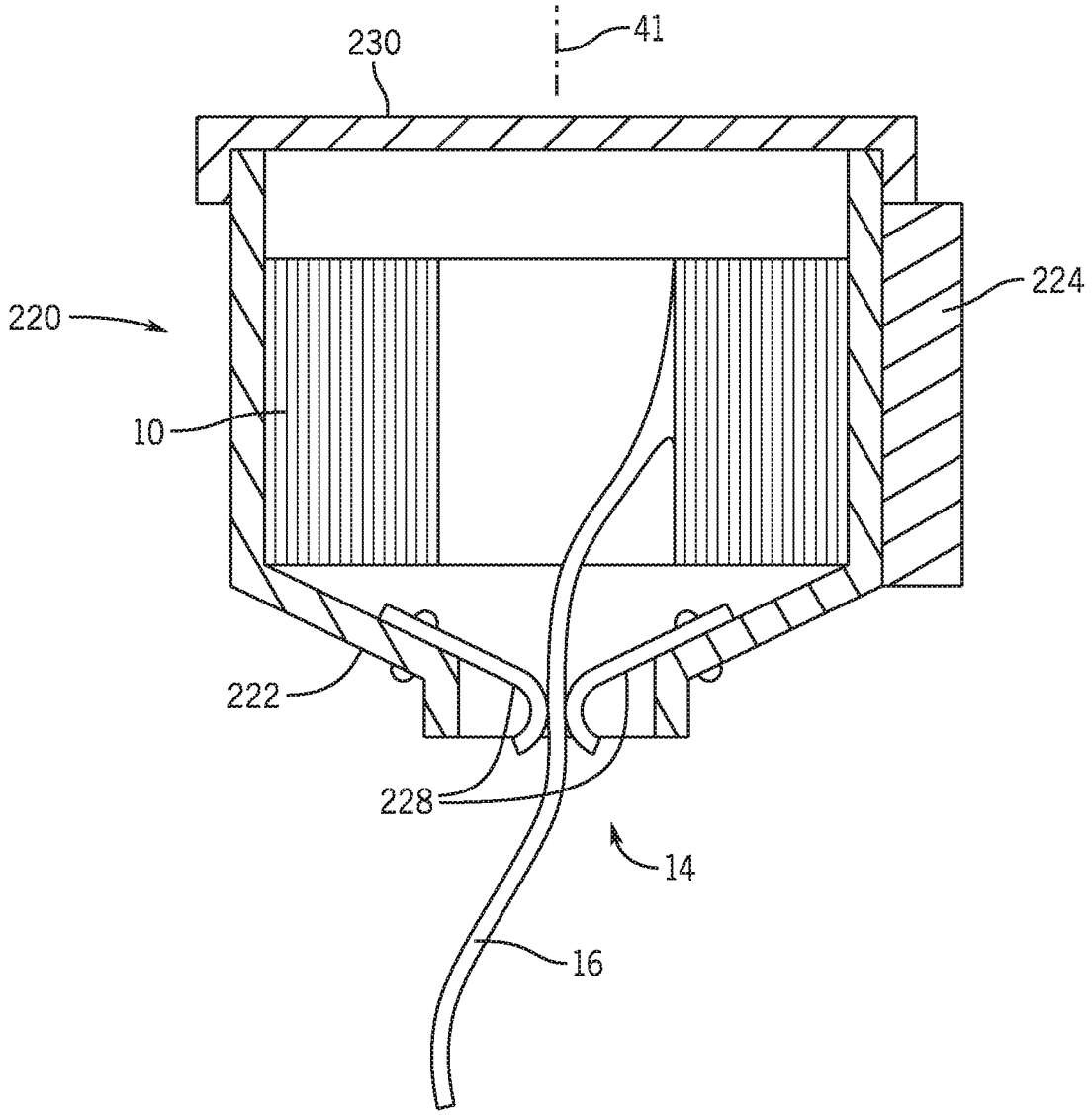
FIG. 21 is a cross-sectional view in elevation of FIG. 20 along line 21-21 showing internal spring fingers which produce improved dispensing.

Referring now to FIG. 20, the invention contemplates a dispensing container 220 may be used with the core-less rolls 10 and may be formed having a generally cylindrical container size so that its inner diameter closely receives the outer diameter of a core-less roll 18 therein. As so received within the container 220, the axis 41 of the core-less roll 18 will generally be vertical and the bags 16 exiting downwardly. A lower outer edge of the core-less roll 18 may rest against an outer periphery of a lower funnel shaped portion 222 of the container 220, this funnel shaped portion 222 leading to a downwardly displaced, reduced-size opening 14 through which bags 16 may be dispensed. The opening 14 in this case may be larger than necessary to promote the proper dispensing of the bags 16 but may include internal spring fingers 228 biased together about opposite sides of an individual bag 16 being dispensed to provide a well-defined drag on that bag 16 improving the dispensing of the bags 16, for example, to ensure connection of subsequent bags to a point of exit from the opening 14.

The container 220 may be mounted with the funnel portion 222 downward, for example, as supported by a wall bracket 224 attached to the outer circumference of the container 220. A loosely fitting lid 230 may be used to cover an upper opening of the container 220 through which the core-less roll 18 may be inserted or replaced.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

What we claim is:

1. A compact plastic bag-dispensing package comprising:

a core-less roll providing a web of plastic bags;

a sleeve of shrink-wrap material positioned around the core-less roll and providing a central aperture through which plastic bags may be extracted through the sleeve from the web of plastic bags;

wherein the sleeve is adapted to provide, upon an application of heat, different predetermined amounts of shrinkage at different portions of the sleeve associated with different areas of contact of the core-less roll.

2. The compact plastic bag-dispensing package of claim 1 wherein the sleeve is formed by a sealing of sheets of shrink-wrap material to provide a tube open along an axis before shrinking to receive the core-less roll and wherein the different predetermined amounts of shrinkage are controlled by changing a diameter of the sleeve formed by the sealing at different locations along the axis.

3. The compact plastic bag-dispensing package of claim 1 wherein the sleeve is formed by a heat sealing of sheets of shrink-wrap material to provide a tube along an open axis before shrinking to receive the core-less roll and wherein the different predetermined amounts of shrinkage are controlled by changing a stretching of the shrink-wrap material prior to heat sealing at different locations along the axis.

4. The compact plastic bag-dispensing package of claim 1 wherein the sleeve includes an orifice formed in the sleeve to align with a central bore of the core-less roll and wherein the orifice is provided by a melting of material of the shrink-wrap material to form a thickened rim about the orifice.

5. The compact plastic bag-dispensing package of claim 1 wherein the shrink-wrap material comprises a first and second layer, the first layer presenting an improved affinity for printing ink compared to the second layer.

6. The compact plastic bag-dispensing package of claim 1 where in the sleeve includes a funnel shaped orifice protruding into a center of the core-less role.

7. The compact plastic bag-dispensing package of claim 1 where in the plastic bag of the core-less role are wound about an axis and wherein the sleeve of shrink-wrap material extends along a second axis perpendicular to the axis.

8. The compact plastic bag-dispensing package of claim 1 where in the plastic bag of the core-less role are wound about an axis and wherein the sleeve of shrink-wrap material extends along a second axis parallel to the axis.

* * * * *